US006078731A

United States Patent [19]

Arold et al.

[11] Patent Number: 6,078,731

[45] Date of Patent: Jun. 20, 2000

[54] HEATER HOUSING

[75] Inventors: Jonathan B. Arold, Exeter; E. Forrest Decatur, Jr., East Kingston; Joseph P. Stark, Dover, all of N.H.

[73] Assignee: Osram Sylvania Inc., Danvers, Mass.

[21] Appl. No.: 09/088,903

[22] Filed: Jun. 2, 1998

Related U.S. Application Data

[60] Provisional application No. 60/048,891, Jun. 6, 1997.

[51] Int. Cl.[7] ..... F24H 1/10

[52] U.S. Cl. ..... 392/492; 392/491

[58] Field of Search ..... 392/492, 465, 392/485, 488, 491, 493

[56] References Cited

U.S. PATENT DOCUMENTS 4,738,196 4/1988 Boissevain ..... 100/93 RP

*Primary Examiner*—Teresa Walberg
*Assistant Examiner*—Thor Campbell
*Attorney, Agent, or Firm*—William H. McNeill

[57] ABSTRACT

A fluid heater comprises a first elongated cylindrical housing having a first diameter, a first end for heated fluid exit, a second end for fluid entrance, and a longitudinal axis. An elongated cylindrical airflow member is fixedly positioned within the housing and coaxial therewith. The airflow member has a second diameter and has a length less than the length of the housing and terminates before the first end. A heating element has a third diameter and is positioned coaxially within the airflow member and is fixed therein. A baffle tube is fixed to the first end in a fluid-tight manner, this baffle tube having a diameter greater than the third diameter of the heating element and less than the diameter of the airflow member. The baffle tube surrounds the forward portion of the heating element.

3 Claims, 2 Drawing Sheets

HEATER HOUSING

This is application claims the benefit of U.S. Provisional Application No. 60/048,891, filed Jun. 6, 1997.

TECHNICAL FIELD

This invention relates to fluid heaters wherein the fluid, which is preferably a gas, flows axially through the heater. More particularly, it relates to such heaters including baffle tubes to restrict the amount of leakage, thereby directing greater amount of the heated fluid to a desired location.

BACKGROUND ART

Fluid heaters of the general type herein described are known and generally comprise an elongated heating element comprised of a continuous length of resistance wire enclosed in a cylindrical insulating tube, generally of quartz. The insulating tube is mounted within a close-fitting metal sheath to protect it from breakage. This metal sheath with its enclosed heating element is in turn mounted within an airflow cylinder which is fixedly mounted within a cylindrical heater housing. One end of the heater is adapted for heated fluid exit and a second end is adapted to provide fluid entrance as well as means for making electrical connection to the heater element. Heaters of this type have generally worked well; however, fluid leakage at the exit reduced the desired efficiency by allowing some of the fluid to escape before it was sufficiently heated.

DISCLOSURE OF INVENTION

It is, therefor, an object of this invention to obviate the disadvantages of the prior art.

It is another object of the invention to improve the efficiency of fluid heaters.

Yet another object of the invention is the enhancement of the heating function of such fluid heaters.

These objects are accomplished, in one aspect of the invention, by the provision of a fluid heater comprising: a first elongated cylindrical housing having a first diameter, a first end for heated fluid exit, a second end for fluid entrance, and a longitudinal axis; an elongated cylindrical airflow member fixedly positioned within said housing and coaxial therewith, said airflow member having a second diameter and having a length less than the length of said housing and terminating before said first end; a heating element having a third diameter positioned coaxially within said airflow member and fixed therein; and a baffle tube fixed to said first end in a fluid-tight manner, said baffle tube having a diameter greater than said third diameter of said heating element and less than the diameter of said airflow member and surrounding said heating element.

The employment of the baffle tube eliminates the fluid leakage and increases the efficiency of the heaters.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
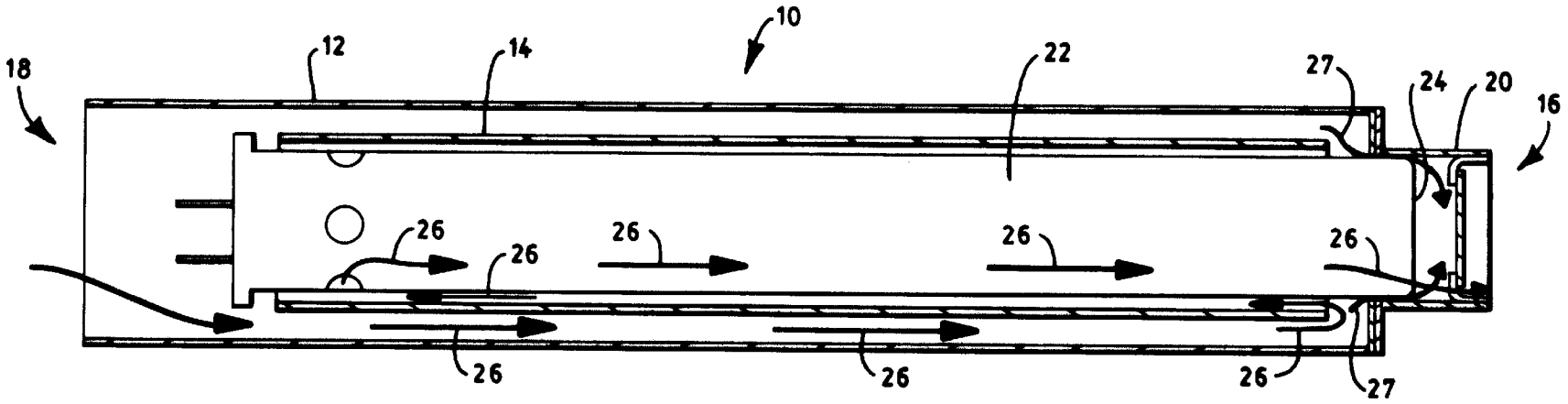
FIG. 1 PRIOR ART
FIG. 1 is an elevational, sectional view of a prior art heater.

Referring now to the drawings with greater particularity, there is shown in FIG. 1 a prior art heater 10 which has a heater housing 12 with an airflow member 14 fixed therein. The housing 12 has an exit end 16 and an entrance end 18. The exit end 16 is provided with an end tube 20. A heating element 22 is coaxially positioned within the airflow member and has a front end 24 which eaters the end tube 20. Arrows 26 indicate the desired direction of fluid flow through the heater 10 and arrows 27 indicate the leakage paths that reduce the efficiency of the heater by allowing unheated fluid to exit.

Figure 2:
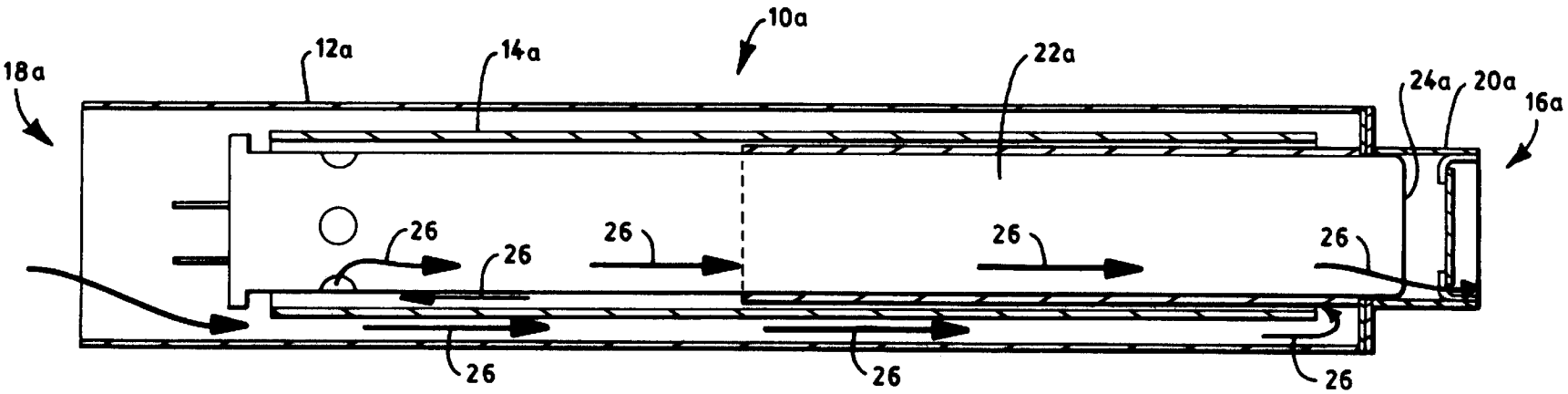
FIG. 2 is a similar view of the heater of this invention.

Referring now to FIG. 2, there is shown a heater 10*a* incorporating the improvement of this invention. Heater 10*a* has a heater housing 12*a* with an airflow member 14*a* fixed therein. The housing 12*a* has an exit end 16*a* and an entrance end 18*a* and the member 14*a* terminates before reaching the exit end 16*a*. The exit end 16*a* is provided with an end tube 20*a*. A heating element 22*a* is coaxially positioned within the airflow member and has a front end 24*a*. In this embodiment a baffle tube 30 is affixed to the internal end 20*b* of end tube 20*a* in a fluid-tight manner, for example, by welding. Alternatively, the baffle tube 30 and the end tube 20*a* can be an integral unit. Baffle tube 30 has a diameter just larger than the diameter of the heating element 22*a* and just smaller than the internal diameter of air flow member 14*a* and has a length that is about one half the length of the air flow member 14*a*. The baffle tube completely seals off the leakage path that existed in the prior art heaters and greatly increases the efficiency of the heaters with which it is employed.

In a preferred form of the invention, the heater housing, airflow member, baffle tube and sheath for the quartz heating unit are stainless steel.

While there have been shown and described what are at present considered the preferred embodiments of the invention, it will be apparent to those skilled in the art that various changes and modifications can be made herein without departing from the scope of the invention as defined by the appended claims.

What is claimed is:

1. A fluid heater comprising: a first elongated cylindrical housing having a first diameter, a first end for heated fluid exit, a second end for fluid entrance, and a longitudinal axis; an elongated cylindrical airflow member fixedly positioned within said housing and coaxial therewith, said airflow member having a second diameter and having a length less than the length of said housing and terminating before said first end; a heating element having a third diameter positioned coaxially within said airflow member and fixed therein; and a baffle tube fixed to said first end in a fluid-tight manner, said baffle tube having a diameter greater than said third diameter of said heating element and less than the diameter of said airflow member and surrounding said heating element, said baffle tube having a length less than the length of said airflow member.

2. The fluid heater of claim 1 wherein said length of said baffle tube is about one half the length of said airflow member.

3. The fluid heater of claim 1 wherein said fluid exit end is provided with an end tube and said end tube and said baffle tube are integral.

* * * * *